US005799888A

United States Patent [19]

Hamaguchi et al.

[11] Patent Number: 5,799,888

[45] Date of Patent: Sep. 1, 1998

[54] JAW CRUSHER

[75] Inventors: Masaki Hamaguchi; Syoji Inomata; Masayuki Kano; Wataru Taga; Hideyuki Inayoshi, all of Takasago, Japan

[73] Assignee: Kabushiki Kaisha Kobe Seiko Sho, Kobe, Japan

[21] Appl. No.: 824,092

[22] Filed: Mar. 25, 1997

[30] Foreign Application Priority Data

Mar. 25, 1996 [JP] Japan ..... 8-067989
Apr. 12, 1996 [JP] Japan ..... 8-091242

[51] Int. Cl.[6] ..... B02C 1/02

[52] U.S. Cl. ..... 241/259.1; 241/268

[58] Field of Search ..... 241/259.1, 259.2, 241/259.3, 264–269

[56] References Cited

U.S. PATENT DOCUMENTS

| | | | |
|---|---|---|---|
| 230,304 | 7/1880 | Marsden | 241/268 |
| 3,326,479 | 6/1967 | Connolly et al. | 241/268 |
| 3,656,696 | 4/1972 | Mailliard | 241/268 |
| 4,765,546 | 8/1988 | Stewart | 241/268 |

FOREIGN PATENT DOCUMENTS

| | | |
|---|---|---|
| 5-9643 | 2/1993 | Japan . |
| 6-182239 | 7/1994 | Japan . |
| 7-9436 | 2/1995 | Japan . |

*Primary Examiner*—Mark Rosenbaum
*Attorney, Agent, or Firm*—Oblon, Spivak, McClelland, Maier & Neustadt P.C.

[57] ABSTRACT

A jaw crusher in which in adjusting an outlet gap, manual releasing and applying operations for a tension force of a tension rod are not necessary, and repair of rough of a contact surface between a toggle block and a wedge and frequency of replacement thereof can be reduced. An outlet gap adjusting apparatus for automatically adjusting an outlet gap, the apparatus capable of securing a space required for maintenance on the back frame side of a swing jaw. A tension spring 21 for applying a tension force to a tension rod is compressed on the counter swing jaw 6 side of a back frame 4 of the jaw crusher 1, and a tendon spring compression cylinder 23 for releasing a compression force is provided. A wedge operating cylinder 17 for inserting a wedge 15 into a gap formed between an inclined surface 12*a* of a toggle block 12 moved toward the swing jaw 6 by a gap adjusting cylinder 13 provided on the counter swing jaw 6 side of the back frame 4 and the back frame 4 is mounted on a cylinder support 16 provided on a back frame horizontal rib 11. A wedge operating cylinder 17 and a wedge 15 can be freely connected and disconnected by mounting and removing a pin mounting means 19. The wedge operating cylinder 17 is inclined after the pin mounting means 19 has been removed whereby the space required for maintenance can be secured on the back frame side of the swing jaw 6 of the jaw crusher 1.

7 Claims, 9 Drawing Sheets

JAW CRUSHER

BACKGROUND OF THE INVENTION

1. Field of the Invention

The present invention relates to improvements in jaw crushers, and more specifically, to the technical field of the jaw crusher capable of easily adjusting an outlet gap of the crushed product formed underside of a fixed jaw plate and a swing jaw plate.

The present invention further relates to improvements in jaw crushers, and more specifically, to the technical field of the jaw crusher capable of securing a maintenance space of the jaw crusher and capable of automatically adjusting an output gap of the crushed product.

2. Description of the Related Art

As is well known, as the crusher continues crushing operation of material such as rocks, crushing teeth of a fixed jaw plate and crushing teeth of a swing jaw plate gradually wear to enlarge an outlet gap of the crushed produce formed underside of both of the plates.

When the outlet gap of the crushed product is enlarged, the crushed product having a grain size within a predetermined range cannot be obtained. Therefore, the outlet gap of the crushed product is adjusted again by an outlet gap adjusting apparatus. Such an outlet gap adjusting apparatus has been heretofore manually operated.

More specifically, the underside of the swingjaw is manually moved toward the fixed jaw plate to form a space into which a shim is inserted to adjust the outlet gap of the crushed product formed underside of the fixed jaw plate and the swingjaw plate. In the manual-operated outlet gap adjusting apparatus, it takes about a few hours to carry out the outlet gap adjusting work by two operators, for example. Thus, it has been desired to realize an outlet gap adjusting apparatus which can perform the outlet gap adjusting work with higher efficiency. An outlet gap adjusting apparatus capable of automatically adjusting an outlet gap is contemplated. Such a well known apparatus is disclosed, for example, in Japanese Utility Model Application Laid-Open No. 9436/1995.

In the following, the conventional jaw crusher provided with a "Horizontal Automatic Gap Adjusting Apparatus" disclosed in the aforementioned publication will be described with reference to FIG. 13 (*a*), a longitudinal sectional side view, and FIG. 13 (*b*), a sectional view taken on line C—C of FIG. 13 (*a*). Reference numeral 51 designates a known single toggle type jaw crusher. That is, this jaw crusher 51 is provided with a swing jaw 54 which is oscillated so as to be moved to and from a fixed jaw 53 by rotation of an eccentric shaft 55 provided on a frame 52. The underside of the swing jaw 54 is supported on the other end side of a toggle plate 56 one end side of which is supported on a toggle block 57 described later. The toggle block 57 is mounted longitudinally slidable on a cross member 58 secured to the frame 52 of the jaw crusher 51.

A pair of left and right symmetrical wedges 59, 59 which are movable in a lateral direction are mounted on the rear part of the cross member 58. The front and rear inclined surfaces of both the wedges 59, 59 slidable come in contact with left and right symmetrical inclined surfaces formed on the back of the toggle block 57.

There is provided a screw jack mechanism 60 comprising an electric motor M for moving both the wedges 59, 59 close to or away from each other, and a screw shaft 60*a* rotated normally or reversely by the electric motor M. Reference numeral 61 designates a tension rod, and reference numeral 62 designates a tension spring to apply a tension force, to the tension rod 61, for pulling the swing jaw 54 toward the cross member 56.

Accordingly, when the screw shaft 60*a* of the screw jack mechanic 60 is rotated to move both the wedges 59, 59 close each other, the toggle block 57 slidably moves forward and the rear portion at the lower end of the swing jaw 54 is pressed forward by means of the toggle plate 56 to come close to the fixed jaw 53. Thereby, between the lower ends of the fixed jaw 53 and the swing jaw 54 is narrowed so that the outlet gap is adjusted.

A further outlet gap adjusting apparatus is disclosed, for example, in Japanese Utility Model Application Laid-Open No. 9643/1993 (which has its object, in the operation of adjusting the outlet gap, to positively hold a toggle plate to prevent it from being disengaged). This conventional outlet gap adjusting apparatus will be described with reference to FIG. 14, a side sectional view of a jaw crusher. In the figure, reference numeral 70 designates a double-toggle type jaw crusher having a fixed jaw plate 71, and a swing jaw 72 provided with a swing jaw plate 72*a* which repeats movement close to and away from the fixed jaw plate 71.

An outlet gap adjusting apparatus 80 described later is provided on a back frame 73 of the jaw crusher 70. This outlet gap adjusting apparatus 80 comprises a block support base 81 provided on the swing jaw 72 of the back frame 73, a block operating rod 82 horizontally held in a hollow portion of the block support base 81, a manually-operated push-out bolt 83 for moving the block operating rod 82 in a direction of the swing jaw 72, a toggle block 84 moved in a direction of the swing jaw 72 through the block operating rod 82, and a first toggle plate 85, a pitman arm 86 and a second toggle plate 87 for transmitting the movement of the toggle block 84 to the lower side of the swing jaw 72.

Thus, when the block operating rod 82 is moved in a direction of the swing jaw 72 by the rotation of the push-out bolt 83 caused by manual operation of an operator, the underside of the swing jaw 72 is pushed through the toggle block 84, the first toggle plate 85, the pitman arm 86 and the second toggle plate 87 and moved toward the fixed jaw plate 71 so that an outlet gap t of the crushed product formed underside of the fixed jaw plate 71 and the swingjaw plate 72*a* is adjusted A shim 84*a* is interposed in a gap between the toggle block 84 and the block support base 81.

According to the above-described conventional "Horizontal Automatic Gas Adjusting Apparatus", since the screw shaft 60*a* of the screw jack mechanism 60 can be merely rotated by the electric motor M to adjust the outlet gap, this apparatus is excellent in the fact that the outlet gap can be adjusted in much more shorter time than the conventional manually-operated outlet gap adjusting work.

However, as will be better understood from FIG. 13 (*a*), this requires heavy labor such that prior to adjustment of the gap, i.e. the outlet of the crushed product, a nut 63 a lock-nut 63' for compressing the tension spring 62 to apply the tension force to the tension rod 61 is loosened to release the tension force by the tension spring 62 to the tension rod 61, and after termination of gap adjustment, the nut 63 is tightened against the powerful spring force of the tension spring 62 in order to apply the tension force to the tension rod 61, and in addition, both the wedges 59, 59 are slidably moved in the state in which they are in contact with the toggle block 57. Therefore, the contact surface between the wedges 59, 59 and the toggle block 57 tends to become rough, thus requiring repairs of the contact surface and increasing the frequency of replacement of the wedges 59, 59 and the toggle block 57.

It is therefore a primary object of the present invention to provide a jaw crusher capable of eliminating manual operation for releasing and applying a tension force to a tension rod, and of positively preventing a contact surface between wedges and a toggle block from roughening.

Further, in order to meet the demand of automation of the outlet gap adjusting operation as described above and to render the maintenance of the jaw crusher easy, the space on the back plate side of the swing jaw plate is desired to be wide, and accordingly, the outlet gap adjusting apparatus is demanded to be compact. For example, in the case where a hydraulic cylinder is employed in order to automate the outlet gap adjusting apparatus, there requires a horizontally-disposed hydraulic cylinder for moving the toggle block toward the swing jaw plate, and a vertically-disposed hydraulic cylinder for holding the toggle block capable of withstanding reaction from the swing jaw plate transmitted through the toggle plate at the moved position. However, the vertically-disposed hydraulic cylinder largely occupies the space on the back plate side of the swing jaw plate which is severely restricted in terms of space to interfere with maintenance of the jaw crusher, thus rendering the automation of the outlet gap adjusting apparatus difficult.

Of course, if the vertically-disposed hydraulic cylinder is designed to be a detachable type, an inconvenience with respect to the maintenance of the jaw crusher can be overcome. In this case, however, for the adjusting work in mounting or dismounting the hydraulic cylinder, particularly, in mounting the hydraulic cylinder, time and labor equal to or more than the manual outlet gap adjustment are required, thus failing to employ such means as described above.

From the foregoing, it is a second object of the present invention to provide a jaw crusher capable of automatically adjusting an outlet gap of the crushed product and capable of being applied to not only a new jaw crusher but also an already used jaw crusher without impairing a maintenance space.

SUMMARY OF THE INVENTION

For solving the aforementioned problems, according to the present invention in one aspect, there is provided a jaw crusher comprising a fixed jaw plate, a swing jaw provided with a swing jaw plate on the fixed jaw plate side which repeats movement close to and away from the fixed jaw plate, a toggle block mounted on a back frame for moving the underside of the swing jaw toward the fixed jaw plate through a toggle plate in order to adjust an outlet gap of the crushed product formed underside of the fixed jaw plate and the swingjaw plate, a gap adjusting cylinder disposed on the counter swing jaw side of the back frame to move the toggle block toward the swing jaw, a wedge operating cylinder for inserting and removing a wedge between the back frame and the toggle block, a tension spring for applying a tension force to a tension rod one end side of which is placed in contact with the counter swing jaw side of the back frame and on the other end side is disposed a push plate, the tension rod being connected to the swing jaw through a rod connecting pin, and a tension spring compression cylinder one end side of which is pivotally mounted on the counter swing jaw of the back frame to press the push plate on the other end the of said tension spring through a pressure fame and release a press force.

Further according to the present invention, there is provided the jaw crusher, wherein a guide frame having a guide portion for reciprocatively guiding the pressure frame in a direction of moving close to and away from the back frame.

Further according the present invention, there is provided the jaw crusher, where a detachable low friction member made of resin is provided on the guide portion of the guide frame.

Further according to the present invention, there is provided the jaw crusher, wherein a spring washer is mounted on the push plate, and a rod for pressing the spring washer is provided on the spring washer side of the pressure frame.

Further according to the present invention, there is provided the jaw crusher, wherein a contact surface of the rod of the spring washer is in the form of a concave surface.

In another aspect of the present invention, there is provided a jaw crusher in which a toggle block mounted on a back frame for moving underside of a swing jaw provided with a swingjaw plate toward the fixed jaw plate side on the fixed frame side through a toggle plate is moved to adjust an outlet gap of the crushed product formed underside of said swing jaw plate and said fixed jaw plate. The jaw crusher comprises a gap adjusting cylinder disposed on the counter swing jaw side of the back frame to move the toggle block toward the swing jaw, a wedge removably inserted between the back frame and the toggle block, a wedge operating cylinder secured to a cylinder support rotated about a hinge pin on the counter swing jaw side of the back frame, a detachable pin mounting means for fixing both ends of a connecting pin provided at the extreme end of a rod of the wedge operating cylinder, and a detachable supporting means for fixing the cylinder support when the wedge operating cylinder is in a upright state.

The present invention will be described hereinafter with reference to the accompanying drawings

DETAILED DESCRIPTION OF THE EMBODIMENTS

The jaw crusher according to an embodiment of the present invention will be described hereinafter with reference to FIG. 1 (a partly omitted side sectional view), FIG. 2 (a sectional view taken on line A—A of FIG. 1), FIG. 3 (a sectional view taken on line B—B of FIG. 1) (upperside shows a compressed state of a tension spring, and underside shows a state in which a compressed force is released, and FIGS. 4 to 9 (explanatory views of the procedure for adjusting an outlet gas of the jaw crusher).

Figure 1:
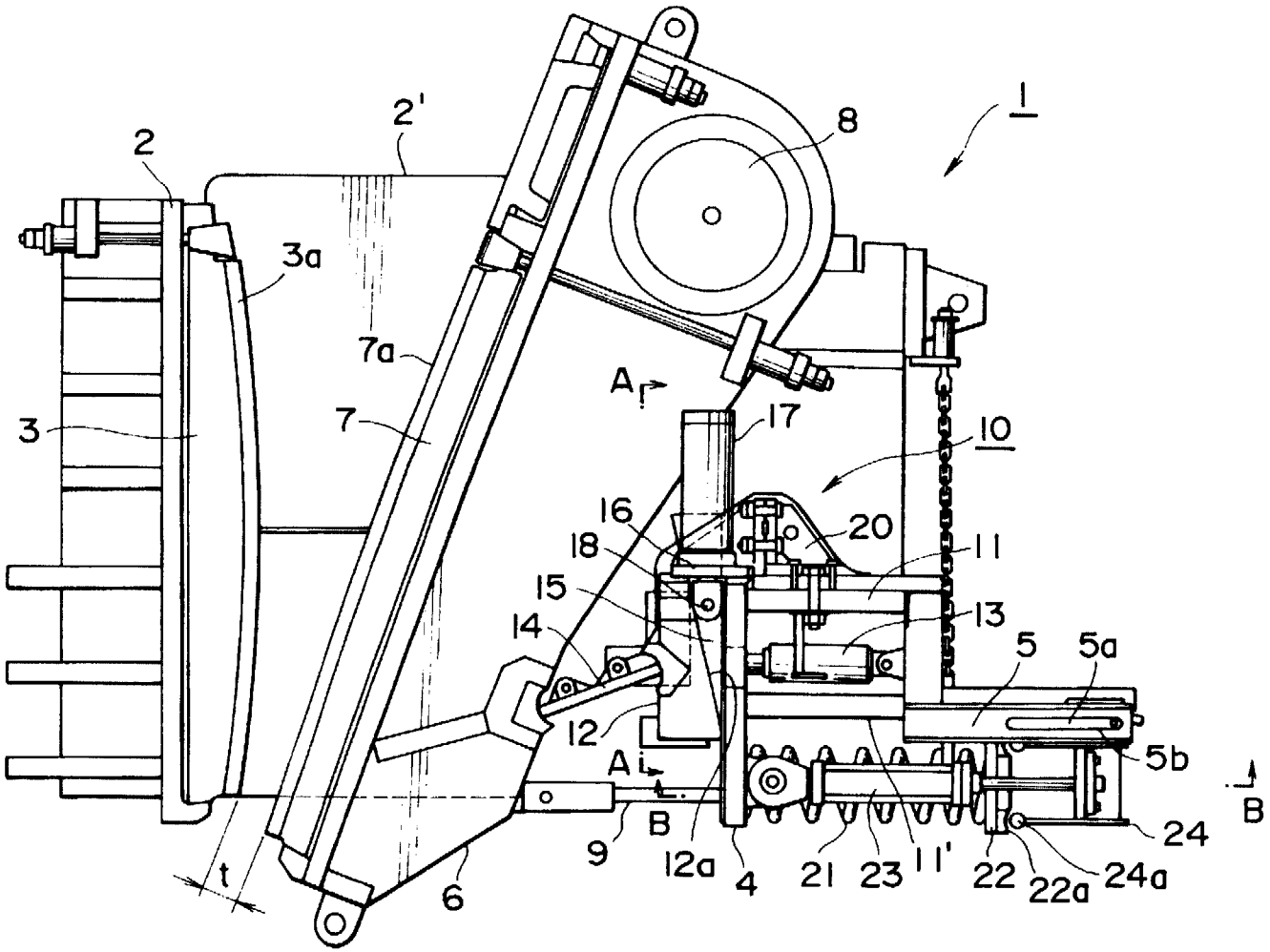
FIG. 1 is a partly omitted side sectional view of a jaw crusher according to an embodiment of the present invention.

In FIG. 1, reference numeral 1 designates a jaw crusher, in which a fixed jaw plate 3 is vertically secured to a front frame 2 with crush teeth 3*a* directed at the counter front frame 2. There is provided a swing jaw 6 to which is secured a swing jaw plate 7 with crush teeth a directed at the fixed jaw plate 3, said swing jaw 6 which is repetitively moved close to and away from the fixed jaw plate 3 by rotation of an eccentric shaft 8 supported by a side Same 2'.

Back frame horizontal ribs 11, 11' which constitute a part of an outlet gap adjusting apparatus 10 described later are secured in a vertically spaced relation to the surface of the swingjaw 6 of a back frame 4 on the counter swing jaw plate 7 of the swing jaw 6. At the lower position of the lower back frame horizontal rib 11', an extreme end of tension rods 9 (a pair of which are provided as shown in FIG. 3) which extend through the back frame 4 and capable of moving in a longitudinal direction is connected to a lower part of the swing jaw plate 7 through a pin. Push plates 22 are mounted on the rear ends of the tension rods 9, 9' and a tension spring 21 is interposed between the back frame 4 and the push plate 22.

On the counter swing jaw 6 side of the back frame 4 and between a pair of tension springs 21, 21 is disposed a tension spring compression cylinder 23 described later which compresses the tension springs 21, 21' and releases the compression thereof. To the extreme end of a rod of the tension compression cylinder 23 is connected a pressure frame 24, which is guided by guide grooves 5*a* provided on both sides widthwise of a guide frame 5 projected rearward from the backframe horizontal ribs 11, 11' supporting the back frame 4, which can be moved longitudinally in a direction of moving close to the swingjaw 6 and in a direction of moving away therefrom, and which compresses the pair of the tension springs 21, 21' through the push plates 22.

That is, the pressure frame 24 can be guided by the guide groove 5*a* to evenly compress the pair of tension springs 21, 21'. A low friction member 5*b* formed of resin or nylon is detachably mounted on the guide groove 5*a* by a mechanical fastening means such as a plate bolt. This provides an effect of shortening repair work time such that when the guide surface becomes roughened, the repair of the guide groove 5*a* is terminated merely by replacing the low friction member 5*b* to shorten the time required for repairs.

A spring washer 22*a* having a concave contact surface is mounted on the pressure frame 24 side of the push plate 22, and a round press member 24*a* formed from a rod is provided on the contact portion with respect to the spring washer contact surface. Accordingly, even if the tension spring 21 is inclined, the tension spring 21 can be compressed accurately.

The constitution of the outlet space adjusting apparatus 10 will be described below. Upwardly of the tension rod 9 of the surface on the swing jaw 6 side of the back frame 4 is provided a toggle block 12 having an inclined surface 12*a* on the back frame 4 side and being moved toward the swing jaw 6 by extension of the rod of a space adjusting cylinder 13 held horizontally between the back frame horizontal ribs 11, 11'. The movement of the toggle block 12 is transmitted to an upper position above a connecting position of the tension rod 9 of the swing jaw 6 through a toggle plate 14 so that the underside of the swing jaw 6 is moved in the direction of the fixed jaw plate 3.

A wedge 15 with an acute angle portion directed downward is interposed between an inclined surface 12*a* of the toggle block 12 and the surface on the swing jaw 6 side of the back frame 4. A notch 15*a* opened upwardly of a thick-wall portion is provided in the wedge 15. On the inner surface opposed to the notch 15 are provided a pair of detachable pin mounting means 19, 19 for connecting a connecting pin 18 provided on the extreme end of a wedge operating cylinder 17 described later to the wedge 15.

The wedge operating cylinder 17 is mounted on a cylinder support 16 secured onto the upper back same horizontal rib 11, as shown in FIG. 1.

The cylinder support 16 is rotated about a hinge pin so that the wedge operating cylinder 17 in the vertical state is inclined backward, the cylinder support 16 being fixed by a detachable support fixing means 10 when the wedge operating cylinder 17 is in the vertical state. That is, when the wedge operating cylinder 17 is maintained in the vertical state, the connecting pin 18 provided at the extreme end of the rod of the wedge operating cylinder 17 is connected to the wedge 15 by the pin mounting means 19, 19, and when the wedge operating cylinder 17 is caused to be inclined, the pin mounting means 19, 18 are removed to separate the wedge operating cylinder 17 from the wedge 15.

The operation of the jaw crusher 1 constituted as described above will be explained sequentially with reference to FIGS. 4 to 9. Prior to adjustment of an outlet gap t of the jaw crusher 1, the rod of the space adjusting cylinder 13 is contracted while the rod of the tension spring compression cylinder 23 is extended, as shown in FIG. 4, and a tension force is exerted on the tension rod 9 by means of the force of the tension spring 21.

Figure 4:
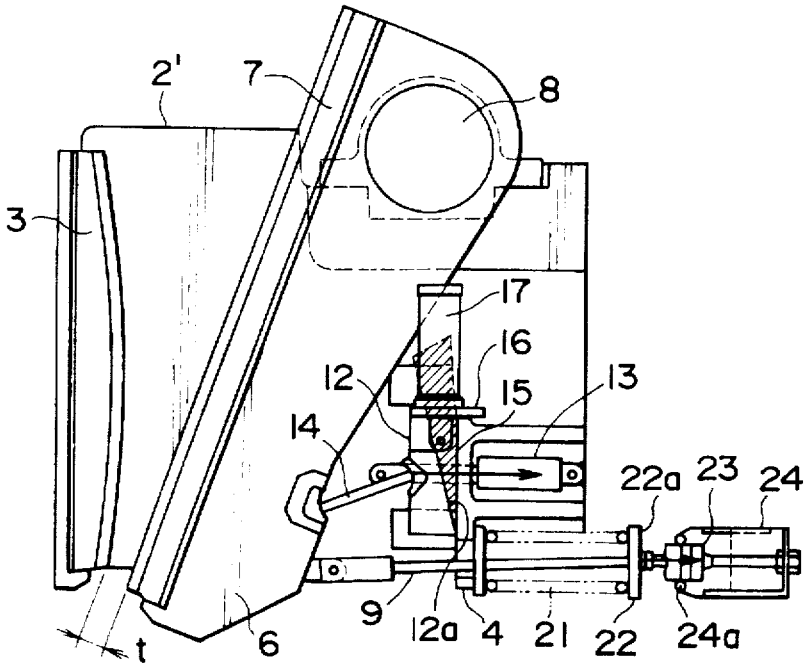
FIG. 4 is an explanatory view of a procedure for adjusting an outlet gap according to an embodiment of the present invention.
Figure 5:
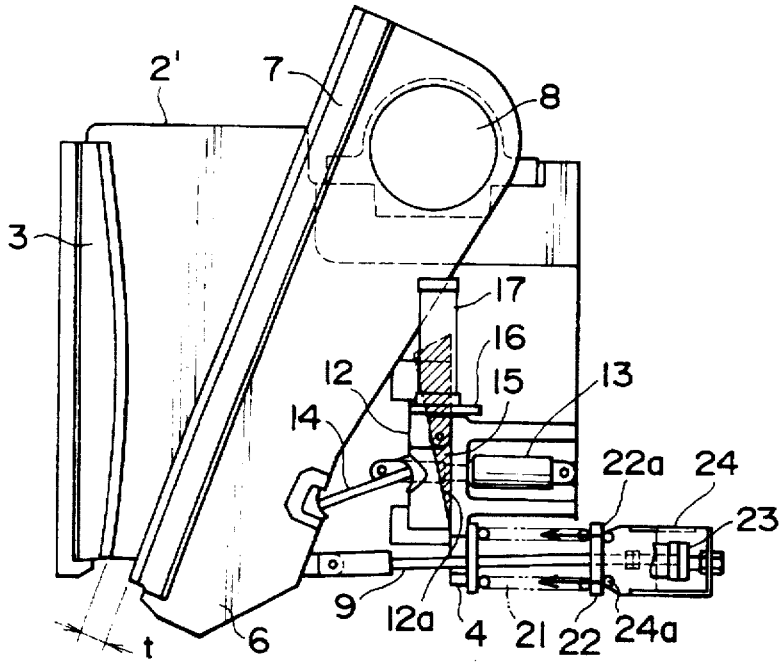
FIG. 5 is an explanatory view of a further procedure for adjusting an outlet gap according to an embodiment of the present invention.

The continuation of crushing material such as rocks by means of the jaw crusher 1 in the state as shown in FIG. 4 causes the wear of the crush teeth 3*a* of the fixed jaw plate 3 and the crush teeth 7*a* of the swing jaw plate 7. Then, when the outlet gap t, the outlet of the material, formed underside of the fixed jaw plate 3 and the swing jaw plate 7 is widened, the outlet gap t of the jaw crusher 1 is adjusted to a predetermined spacing. In adjusting the outlet gap t, as shown in FIG. 5, the rod of the tension spring compression cylinder 23 is contracted and the tension spring 21 is compressed through the pressure frame 24, the round press member 24*a*, the spring washer 22*a* and the push press 22 to release the tension force with respect to the tension rod 9 by means of the tension spring 21.

Figure 6:
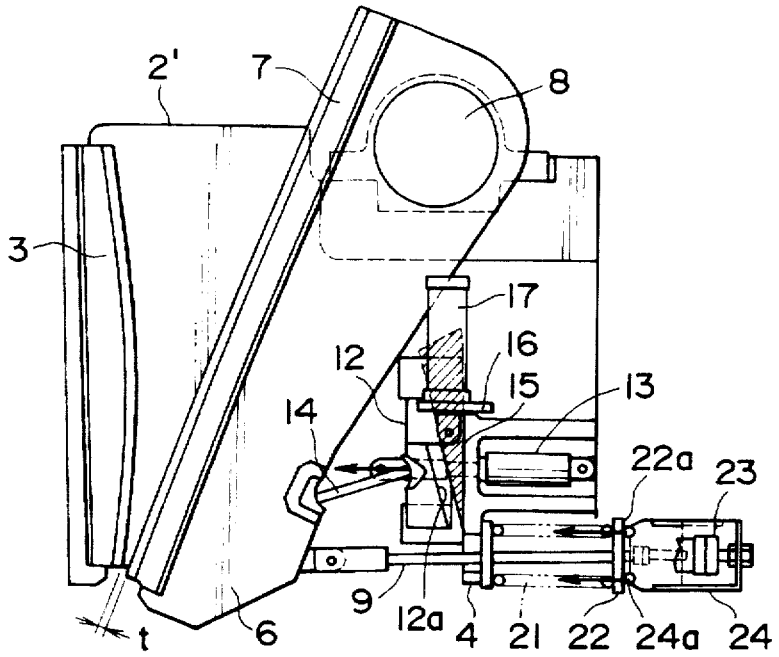
FIG. 6 is an explanatory view of another procedure for adjusting an outlet gap according to an embodiment of the present invention.

When the tension force with respect to the tension rod 9 is released by the compression of the tension spring 21, as shown in FIG. 6, the space adjusting cylinder 13 is extended so that the outlet gap t between the underside of the fixed jaw plate 3 and the underside of the swing jaw plate 7 assumes a predetermined dimension to push and move the underside of the swing jaw 6 through the toggle block 12 and the toggle plate 14. With this, a gap is formed between the inclined surface 12*a* of the toggle block 12 and the inclined surface of the wedge.

Figure 7:
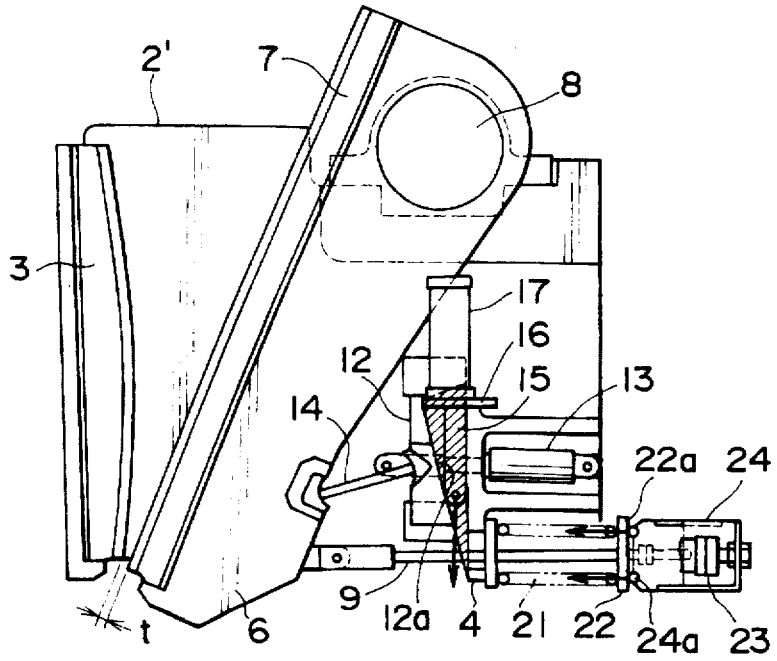
FIG. 7 is an explanatory view of a still another procedure for adjusting an outlet gap according to an embodiment of the present invention.

When the outlet gap t assumes a predetermined dimension by the extension of the rod of the gap adjusting cylinder 13, the rod of the wedge operating cylinder 17 is extended to move down the wedge 15 till the inclined surface of the wedge 15 comes in contact with the inclined surface 12*a* of the toggle block 12, as shown in FIG. 7, so as to eliminate the gap formed between the inclined surface 12*a* of the toggle block 12 and the inclined surface of the wedge 15.

Figure 8:
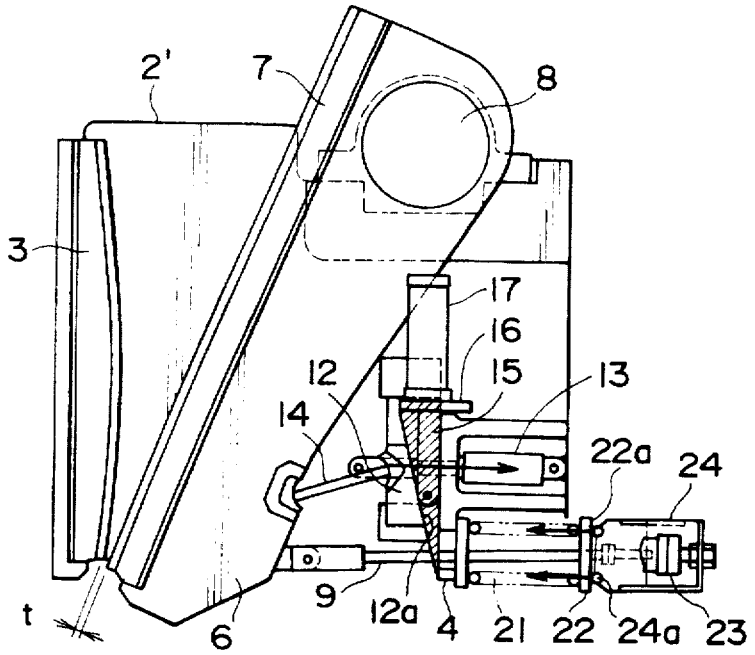
FIG. 8 is an explanatory view of another procedure for adjusting an outlet gap according to an embodiment of the present invention.
Figure 9:
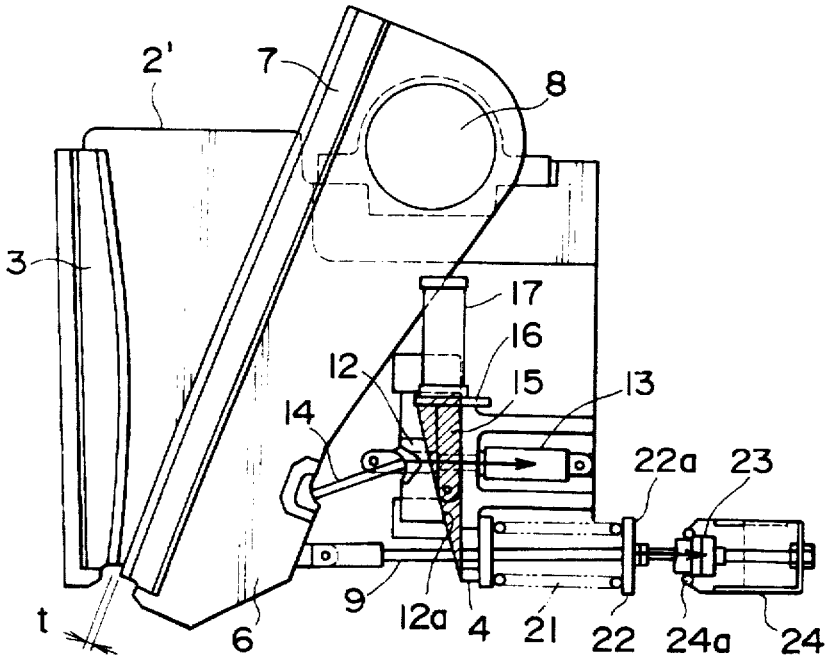
FIG. 9 is an explanatory view of another procedure for adjusting an outlet gap according to an embodiment of the present invention.

When the wedge 15 is moved down so that the inclined surface of the wedge 15 comes in contact with the inclined surface 13*a* of the toggle block 12, the rod of the gap adjusting cylinder 13 is contracted to draw the toggle block 12 toward the wedge 15, and the wedge 15 is pressed and fixed by the toggle block 12, as shown in FIG. 8. As shown in FIG. 9, when the rod of the tension spring compression cylinder 23 is extended to release the compression force of the tension spring 21, the tension force caused by the force of the tension spring 21 exerts on the tension rod 9, and the jaw crusher 1 is restored to a reoperable state.

As described above, the release and application of the tension force with respect to the tension rod 9 becomes enabled merely by contraction and extension of the tension spring compression cylinder 23. Therefore, as compared with prior art which requires loosening and tightening operations of the nut, the releasing and applying operations with respect to the tension rod are extremely easy and can be terminated in an extremely short time.

In adjusting the outlet gap t, it will suffice that the wedge 15 is inserted between the back frame 4 and the inclined surface of 12*a* of the toggle block 12 by the operation of the wedge operating cylinder 17 to eliminate the gap between the back frame 4 and the inclined surface 12*a* of the toggle block 12. Since this is not the constitution that sliding is made in the state where the wedge is placed in contact with the toggle block as in prior art, the inclined surface 12*a* of the toggle block 12 and the inclined surface of the wedge 15 are not roughened, and the repair of the contact surface and the frequency of replacement of the toggle block 12 and the wedge 15 are less required.

While in the foregoing, a description has been made of the case where the technical idea of the present invention is applied to the single toggle type jaw crusher, it is to be noted that the technical idea of the present invention can be also applied to a known double toggle type jaw crusher. Therefore, the scope of the technical idea of the present invention is not limited by the aforementioned embodiments.

Next, a rising and falling mechanism for the wedge operating cylinder of the jaw crusher (of a single toggle type) according to an embodiment of the present invention win be described hereinafter with reference to FIG. 1 (a partly omitted side sectional view of a jaw crusher provided with an outlet gap adjusting apparatus), FIG. 2 (an explanatory view of explaining the connecting state between the wedge operating cylinder and the wedge), FIG. 10 (a sectional view taken on line A—A of FIG. 2), FIG. 11 (a perspective vie of a pin mounting means), and FIG. 12 (an explanatory view of explaining the rising and falling state of the wedge operating cylinder).

Figure 2:
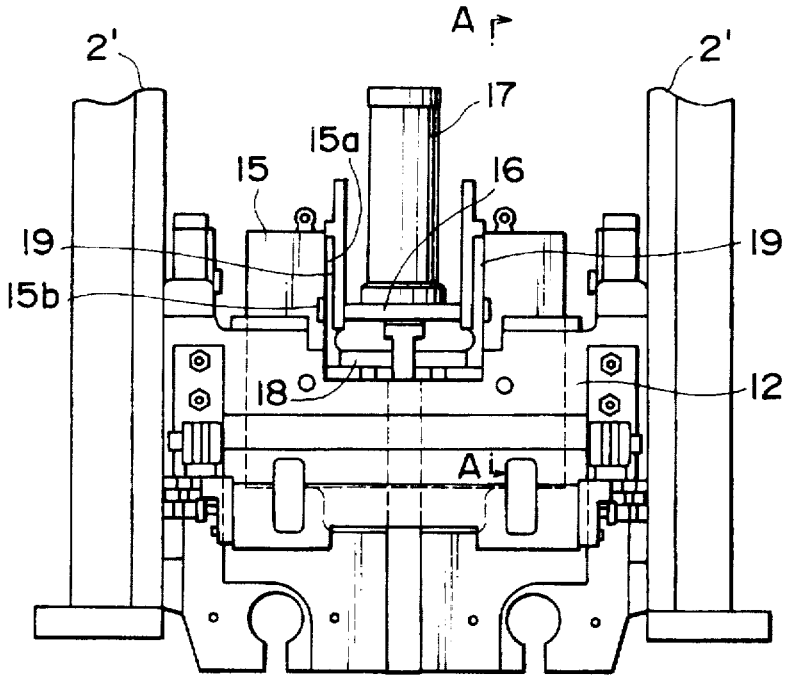
FIG. 2 is a sectional view taken on line A—A of FIG. 1.
Figure 3:
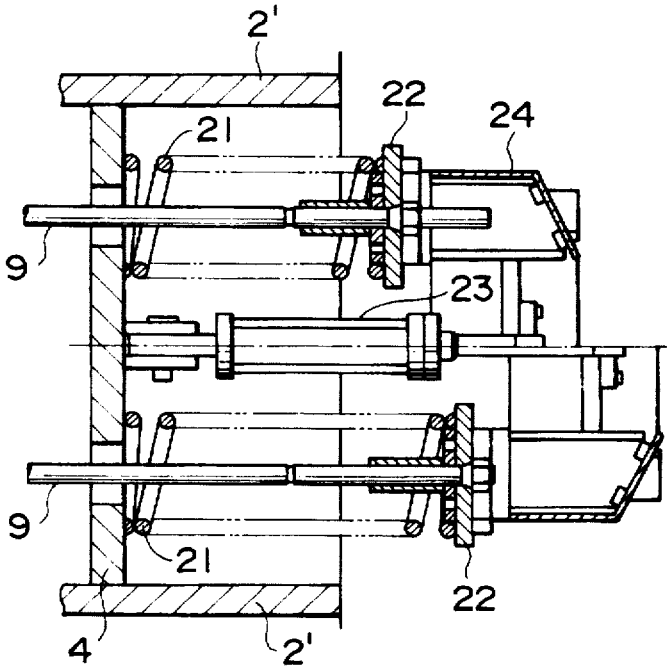
FIG. 3 is a sectional view taken on line B—B of FIG. 1.
Figure 10:
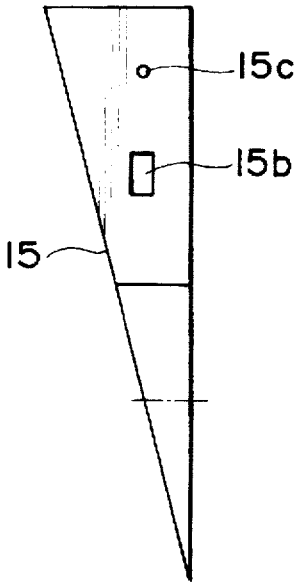
FIG. 10 is a sectional view taken on line A—A of FIG. 2 (*a*)
Figure 11:
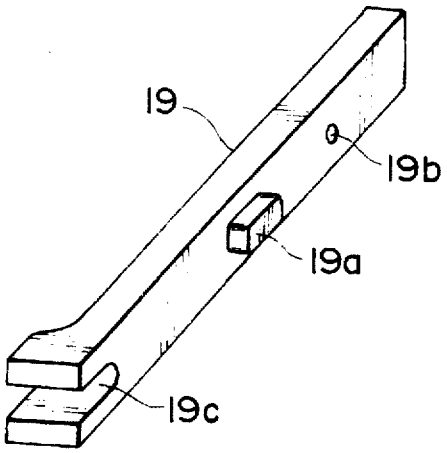
FIG. 11 is a perspective view of a pin mounting means of an outlet gap adjusting apparatus according to an embodiment of the present invention.

Inner surfaces opposed to the notch 15*a* shown in FIG. 2 are provided with a fitting slot 15*b* which extends from a thick-wall side to a thin-wall side and a tapped hole 15 *c*, as shown in FIG. 10. In the notch 15*a* is mounted a pin mounting means 19, as shown in FIG. 3, which is provided with a fitting protrusion 19*a* having a shape corresponding to that of the fitting slot 15*b* and a through-hole 19*b* through which threads extend. The pin mounting means 19 is provided at the extreme end with a pin keep surface 19*c* for keeping an outer peripheral surface of an end of a connecting pin of a wedge operating cylinder 17 described later. It is noted that the fitting slot 15*b* may be replaced by a long groove, for example.

The wedge operating cylinder 17 is mounted on the cylinder support 16 secured to the upper surface of the back frame horizontal rib 11, as shown in FIG. 1. The cylinder support 16 comprises a cylinder mounting plate 16*a* on which is mounted the wedge operating cylinder 17, and a fixing plate 16*b* provided at right angles to the cylinder mounting plate 16*a* and which will be vertical when the cylinder mounting plate 16*a* is parallel The cylinder support 16 is connected so that an intersection between the cylinder mounting plate 16*a* and the fixing plate 16*b* can be rotated about a hinge pin 16*c* provided on the extreme end of the upper surface of the back frame horizontal rib 11.

That is, when the fixing plate 16*b* of the cylinder support 16 is in the vertical state, the cylinder support 16 is fastened to a support fixing means 20 detachably mounted on the upper surface of the back frame horizontal rib 11. By this fastening, the cylinder mounting plate 16*a* is maintained in a horizontal state, and the wedge operating cylinder 17 is kept in a upright state, that is, in a vertical state. Then, when the support fixing means 20 is removed and the cylinder mounting plate 16*a* is rotated rearward from the horizontal state whereby the wedge operating cylinder 17 in the vertical state may be inclined rearward A connecting pin 18 is fitted in the extreme end of the rod of the wedge operating cylinder 17, as shown in FIGS. 1 and 2, and when the wedge operating cylinder 17 is maintained in the vertical state, the pin mounting means 19, 19 are mounted on the surface opposed to the notch 15*a* of the wedge 15 . The extreme end of the connecting pin 18 is fixed between the pin keep surfaces 19*c*, 19*c* of the pin mounting means 19, 19 and the bottom surface of the notch 15*a*, and the wedge 15 is connected to the extreme end of the rod of the wedge operating cylinder 17. On the other hand, when the wedge operating cylinder 17 is rotated rearward by making the cylinder mounting plate 16*a* vertical and removed, the pin mounting means 19, 19 are removed.

Since the wedge operating cylinder 17 occupies a space required for maintenance between the swing jaw 6 and the back frame 4, it interferes with the maintenance work of the jaw crusher 1. So, in the case where the jaw crusher 1 is subjected to maintenance, the support fixing means 20 is removed, and the pin mounting means 19, 19 are removed to release the connecting state between the rod of the wedge connecting cylinder 17 and the wedge 15.

Figure 12:
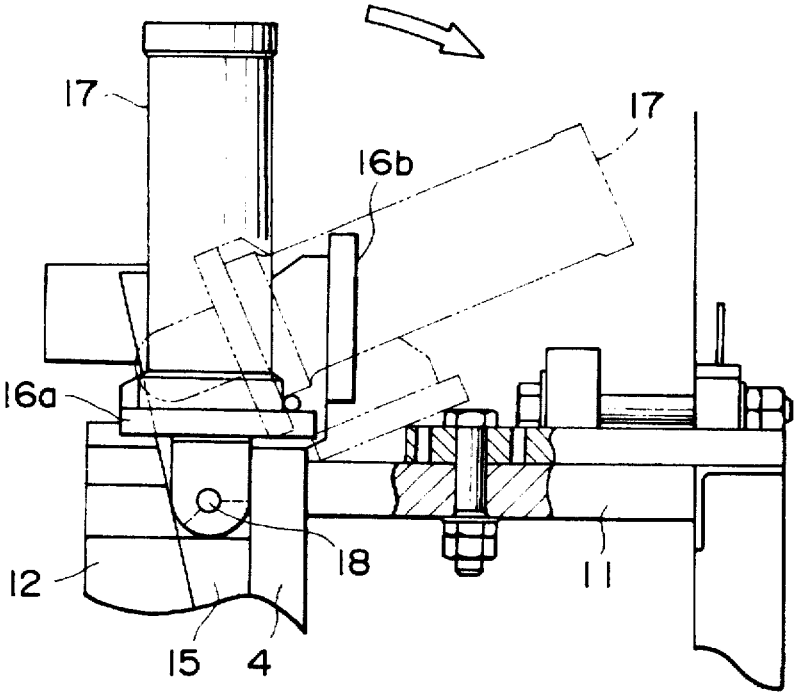
FIG. 12 is an explanatory view of explaining the rising and falling of a wedge operating cylinder of the outlet gap adjusting apparatus according to an embodiment of the present invention.
Figure 13A:
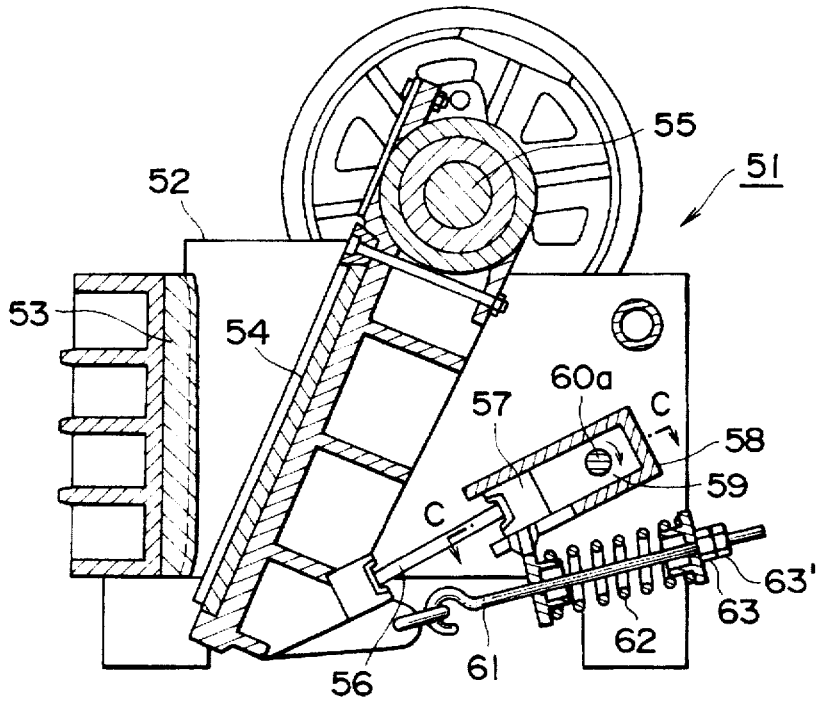
FIG. 13a PRIOR ART
FIGS. 13 (*a*) and 13 (*b*) show prior art, FIG. 13 (*a*) being a longitudinal sectional side view of a jaw crusher provided with "Horizontal automatic gap adjusting apparatus", FIG. 13 (*b*) being a sectional view taken on line C—C of FIG. 13 (*a*)
Figure 13B:
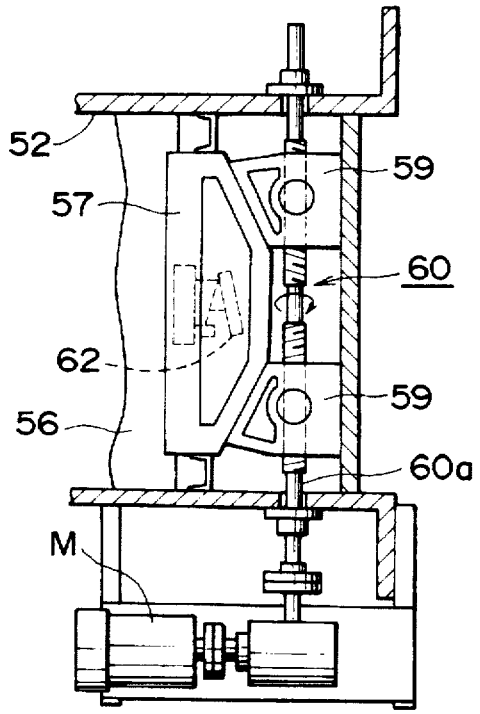
FIG. 13b PRIOR ART
Figure 14:
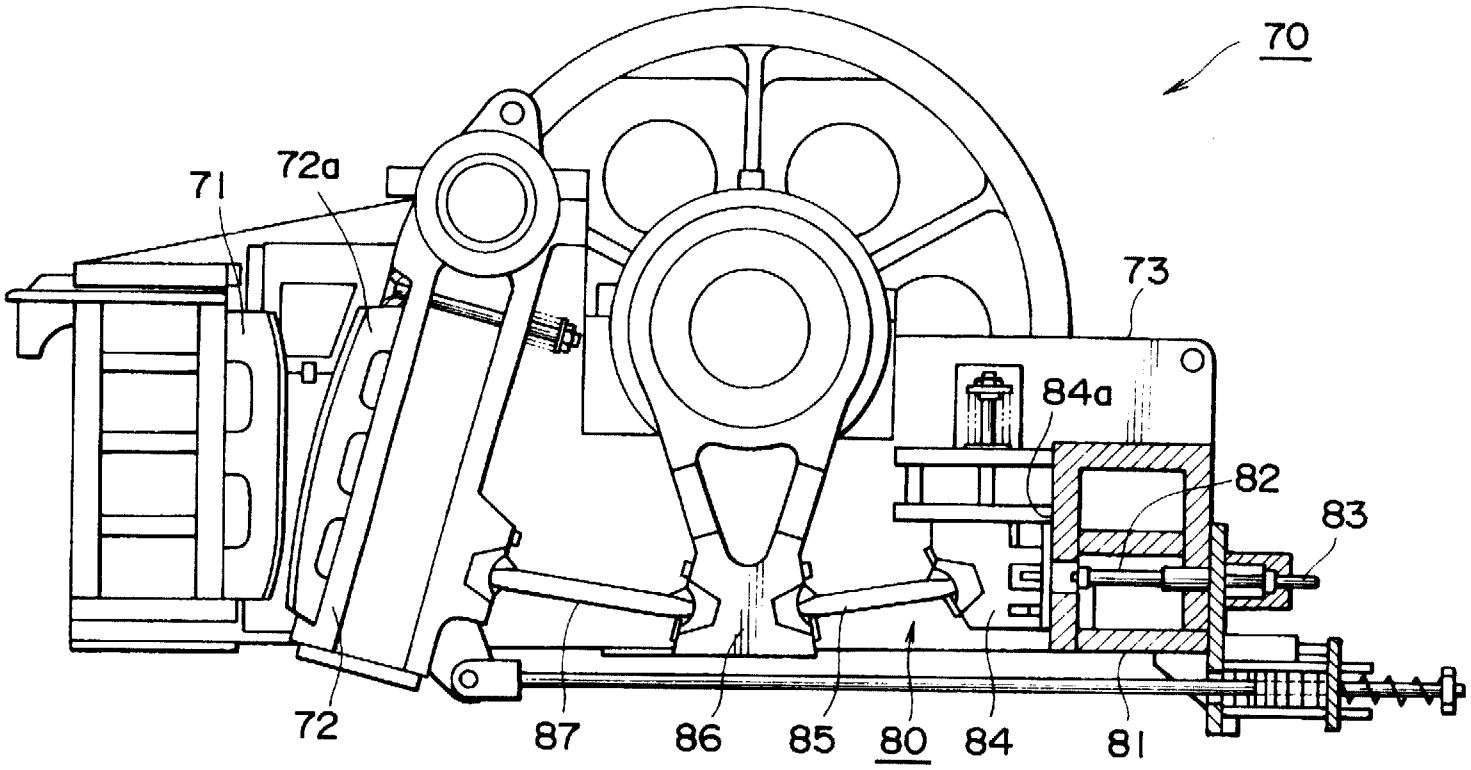
FIG. 14 PRIOR ART
FIG. 14 is a side sectional view of a conventional jaw crusher.

Next, the cylinder support 16 is rotated rearward about the hinge pin 16*c* to make the cylinder mounting plate 16*a* vertical so that the wedge operating cylinder 17 is fallen in a direction of a downward (white) arrow and inclined as indicated by an imaginary line, as shown in FIG. 12. Then, the space required for maintenance is secured between the swing jaw 6 and the back frame 4 to eliminate the interference with the maintenance of the jaw crusher 1. Therefore, the jaw crusher can be subjected to maintenance easily, similar to the case of the jaw crusher provided with the outlet gap adjusting apparatus as in prior art Upon termination of the maintenance of the jaw crusher 1, the operation reversed to the above is carried out. That is, the wedge operating cylinder 17 is risen in a direction reversed to the (white) arrow to make it vertical as indicated by the solid line as shown in FIG. 12, the cylinder support 16 is fixed by the support fixing means 20, and the rod of the wedge operating cylinder 17 and the wedge 15 are connected through the connecting pin 18 by mounting the pin mounting means 19. Then, the outlet gap t can be restored any time to an adjustable state. In this case, since the position adjusting work of the wedge operating cylinder 27 is not necessary, it is possible to finish the restoring work very simply and in a short period of time.

As described above, according to the jaw crusher 1 in the present embodiment, the wedge operating cylinder 17 can connect and disconnect the wedge 15 merely by detachable operation of the pin mounting means 19, and the wedge operating cylinder 17 is inclined merely by detachable operation of the support fixing means 21 for fixing the rotatable cylinder support 16 to secure the space required for maintenance. Therefore, there is an excellent effect in that this can be also applied to a used jaw crusher. While in the foregoing, a description has been made of the embodiment in which an outlet gap adjusting apparatus is applied to a single toggle type jaw crusher, it is to be noted that an outlet gap adjusting apparatus according to the technical idea of the present invention can be also applied to a conventional double toggle type jaw crusher. Therefore, the scope of the technical idea of the present invention is not limited depending on the type of the jaw crushers.

As described above in detail, according to the jaw crusher of the present invention, the release and application of the tension force relative to the tension rod can be made merely by contracting and extending the rod of the tension spring compression cylinder. Therefore, as compared with prior art which requires loosening and tightening of nuts, the releasing and applying work of the tension force relative to the tension rod can be carried out very easy and can be finished in a very short period of time. Further, in adjusting the outlet gap, there is not employed the constitution in which sliding is carried out in the state where the wedge is in contact with the toggle block but the wedge is merely inserted between the back frame and the toggle block. This provides an excellent effect in that the inclined surface of the toggle block and the inclined surface of the wedge are not roughened, and the repair of the contact surface and the frequency of replacement of the toggle block and the wedge are reduced. Further, as described above in detail, according to the jaw crushers of the present invention, the wedge operating cylinder and the wedge can be easily detachably mounted, and the space required for maintenance of the jaw crusher can be secured by inclining the wedge operating cylinder. Therefore, there is an excellent effect in that this can be applied to a used jaw crusher.

What is claimed is:

1. A jaw crusher comprising:

a fixed jaw plate;

a swing jaw plate;

a back frame;

a toggle block mounted on said back frame;

a gap adjusting cylinder disposed on a side of said back frame opposite said swing jaw plate for moving said toggle block toward said swing jaw in order to adjust an outlet gap for crushed product formed between said fixed jaw plate and said swing jaw plate;

a wedge operating cylinder for inserting and removing a wedge between said back frame and said toggle block;

a tension rod connected to said swing jaw plate through a rod connecting pin;

a tension spring for applying a tension force to said tension rod;

and a tension spring compression cylinder for compressing said tension spring and releasing the compression thereof.

2. The jaw crusher according to claim 1, further comprising a push plate mounted on the rear end of said tension rod and a pressure frame, wherein said tension spring is interposed between said back frame and said push plate, said tension spring compression cylinder is pivotally mounted on said back frame on one end and connected to said pressure frame at the other end, and said pressure frame is placed in contact with said push plate.

3. The jaw rusher according to claim 2, further comprising a guide frame having a guide portion for reciprocatively guiding said pressure frame in a direction of moving close to and away from said back frame.

4. The jaw crusher according to claim 3, wherein a detachable low friction member made of resin is provided on the guide portion of said guide frame.

5. The jaw crusher according to claim 2, further comprising a spring washer mounted on said push plate, and a rod for pressing said spring washer provided on said pressure frame.

6. The jaw crusher according to claim 5, wherein a contact surface of said rod for pressing said spring washer is in the form of a concave surface.

7. A jaw crusher comprising:

a fixed jaw plate;

a swing jaw plate;

a back frame;

a toggle block mounted on said back frame; pg.24 a gap adjusting cylinder disposed on a side of said back frame opposite said swing jaw plate for moving said toggle block toward said swing jaw in order to adjust an outlet gap for crushed product formed between said fixed jaw plate and said swing jaw plate;

a cylinder support rotated about a hinge pin on said back frame;

a wedge operating cylinder for inserting and removing a wedge between said back frame and said toggle block, said wedge operating cylinder being secured to said cylinder support;

a detachable pin mounting means for fixing both ends of a connecting pin provided at an extreme end of a rod of said wedge operating cylinder;

and a detachable support fixing means for fixing said cylinder support when said wedge operating cylinder is in a upright state.

* * * * *